US006340121B1

(12) United States Patent
Lambert

(10) Patent No.: US 6,340,121 B1
(45) Date of Patent: Jan. 22, 2002

(54) FUEL INJECTOR

(75) Inventor: Malcolm David Dick Lambert, Bromley (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/662,616

(22) Filed: Sep. 15, 2000

(30) Foreign Application Priority Data

Sep. 23, 1999 (GB) ..... 9922408

(51) Int. Cl.[7] ..... F02M 61/06
(52) U.S. Cl. ..... 239/533.4; 239/533.12
(58) Field of Search ..... 239/533.3, 533.7, 239/533.8, 533.9, 533.12, 533.4

(56) References Cited

U.S. PATENT DOCUMENTS 3,339,848 A * 9/1967 Geiger ..... 239/533.12
4,216,912 A * 8/1980 Kopse ..... 239/533.4
4,526,323 A * 7/1985 Seifert ..... 239/533.4
4,546,739 A * 10/1985 Nakajima et al. ..... 239/533.4
4,570,853 A * 2/1986 Schmied ..... 239/533.3
5,458,292 A * 10/1995 Hapeman ..... 239/533.4
5,551,634 A * 9/1996 Raab et al. ..... 239/96
5,899,389 A * 5/1999 Pataki et al. ..... 239/533.2
6,279,840 B1 * 8/2001 Buckley ..... 239/533.4

* cited by examiner

*Primary Examiner*—Thomas N. Moulis
(74) *Attorney, Agent, or Firm*—Thomas A. Twomey

(57) ABSTRACT

A fuel injector comprising a nozzle body defining a first bore and an inwardly opening valve member slidable within the first bore, the valve member being engageable with a first seating to control fuel delivery through a first outlet opening provided in the nozzle body. The valve member is provided with a second bore within which an outwardly opening valve needle is slidable, the valve needle being engageable with a second seating to control fuel delivery through a second outlet opening provided in the valve needle. The fuel injector also comprises first and second control chambers for fuel, whereby fuel pressure within the first and second control chambers controls movement of the valve member and the valve needle away from their respective seatings so as to permit fuel delivery through a selected outlet opening. The valve needle may define a flow passage for fuel which communicates with a delivery chamber such that, when the valve needle is moved away from the second seating, fuel within the delivery chamber is able to flow through the flow passage for delivery through the second outlet opening.

17 Claims, 5 Drawing Sheets

FUEL INJECTOR

TECHNICAL FIELD

This invention relates to a fuel injector for use in supplying fuel under pressure to a combustion space of an internal combustion engine. The invention relates, in particular, to an injector suitable for use in supplying fuel to an engine of the compression ignition type, the injector forming part of a common rail fuel system. It will be appreciated, however, that the injector may be used in other applications.

BACKGROUND OF THE INVENTION

In order to reduce the levels of noise and particulate emissions produced by an engine it is desirable to provide an arrangement whereby the rate at which fuel is delivered to the engine can be controlled. It is also desirable to be able to adjust other injection characteristics, for example the spray pattern formed by the delivery of fuel by an injector.

A known fuel injector which permits this to be achieved comprises an outwardly opening valve member which is slidable within a first bore provided in a nozzle body. The valve member is provided with a second bore within which an inwardly opening valve needle is slidable, the valve needle being engageable with a seating to control fuel flow delivery through a first set of outlet openings provided in the valve member. The valve member is also provided with a second set of outlet openings in constant communication with a part of the second bore upstream of the seating, the second set of outlet openings being located such that, when the valve member adopts an inner, closed position within the first bore, the second set of outlet openings are closed by the nozzle body. When the valve member is moved outwardly to an open position, fuel within the second bore is able to flow through the second set of outlet openings into the engine cylinder.

Movement of the valve needle and the valve member is controlled by means of an actuator arrangement to permit fuel delivery through a selected one or both of the first and second sets of outlet openings, thereby enabling the fuel injection characteristic to be varied, in use. A disadvantage of this arrangement is that a relatively high leakage of fuel can occur to the engine cylinder between the nozzle body and the valve member. In addition, the components of the fuel injector are subject to relatively high stresses.

SUMMARY OF THE INVENTION

It is an object of the present invention to provide a fuel injector which permits the fuel injection characteristic to be varied, in use, and which overcomes the aforementioned disadvantages of known fuel injectors having this capability. It is a further object of the present invention to provide a fuel injector in which the fuel injection characteristic can be controlled with improved accuracy.

According to one aspect of the present invention there is provided a fuel injector comprising a nozzle body defining a first bore and an inwardly opening valve member slidable within the first bore, the valve member being engageable with a first seating to control fuel delivery through a first outlet opening provided in the nozzle body, the valve member being provided with a second bore within which an outwardly opening valve needle is slidable, the valve needle being engageable with a second seating to control fuel delivery through a second outlet opening provided in the valve needle, the fuel injector comprising first and second control chambers for fuel, whereby fuel pressure within the first and second control chambers controls movement of the valve member and the valve needle away from their respective seatings so as to permit fuel delivery through a selected outlet opening.

In such an arrangement, movement of the valve needle in an outwards direction away from the second seating permits fuel delivery through the second outlet opening and movement of the valve member away from the first seating in an inwards directions permits fuel delivery through the first outlet opening. Thus, by controlling movement of the valve member and the valve needle, and injecting fuel through a selected one or more of the first or second outlet openings, the fuel injection characteristic, for example the rate of injection of fuel, can be varied, in use.

As movement of the valve member and the valve needle is controlled by controlling fuel pressure within the first and second control chambers, rather than being controlled directly by means of an actuator arrangement, valve needle and valve member movement, and hence the fuel injection characteristic, can be controlled with improved accuracy.

The valve needle may define a flow passage for fuel which communicates with a delivery chamber such that, when the valve needle is moved away from the second seating, fuel within the delivery chamber is able to flow through the flow passage for delivery through the second outlet opening.

The force due to fuel pressure within the flow passage serves to improve the seal between the valve member and the nozzle body, and between the valve needle and the valve member, thereby reducing fuel leakage from the injector.

The delivery chamber is conveniently defined by a part of the second bore provided in the valve needle and the valve member. Conveniently, the valve member may include a guide region which serves to guide sliding movement of the valve needle within the second bore.

The valve member may have a first surface associated therewith, the first surface being exposed to fuel pressure within the first control chamber. The first surface may be carried by a first piston member which is movable with the valve member. The valve needle may have a second surface associated therewith, the second surface being exposed to fuel pressure within the second control chamber. The second surface may be carried by a second piston member which is movable with the valve needle.

The valve needle may be provided with a plurality of appropriately positioned second outlet openings. Alternatively, or in addition, the nozzle body may be provided with a plurality of appropriately positioned first outlet openings.

The fuel injector may include a third control chamber for fuel, the third control chamber communicating with the second control chamber by means of a restricted flow passage, fuel pressure within the third control chamber acting on a third surface associated with the valve needle to urge the valve needle outwardly from the second bore. In use, when fuel pressure within the second control chamber is reduced, fuel pressure within the third control chamber acting on the third surface serves to bias the valve needle away from its seating to permit fuel delivery through the second outlet opening.

According to a second aspect of the invention, there is provided a fuel injector comprising a nozzle body defining a first bore and an inwardly opening valve member slidable within the first bore, the valve member being engageable with a first seating to control fuel delivery through a first outlet opening provided in the nozzle body, the inwardly opening valve member being provided with a second bore within which an outwardly opening valve needle is slidable, the valve needle being engageable with a second seating to control fuel delivery through a second outlet opening provided in the valve needle, the valve needle defining a flow passage for fuel which communicates with a delivery chamber such that, when the valve needle is moved away from the second seating, fuel within the delivery chamber is able to flow through the flow passage for delivery through the second outlet opening.

This provides the advantage that fuel pressure within the flow passage acts in a radially outwards direction and serves to improve the fluid-tight seal between the valve member and the nozzle body and between the valve needle and the valve member, thereby reducing leakage from the fuel injector.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
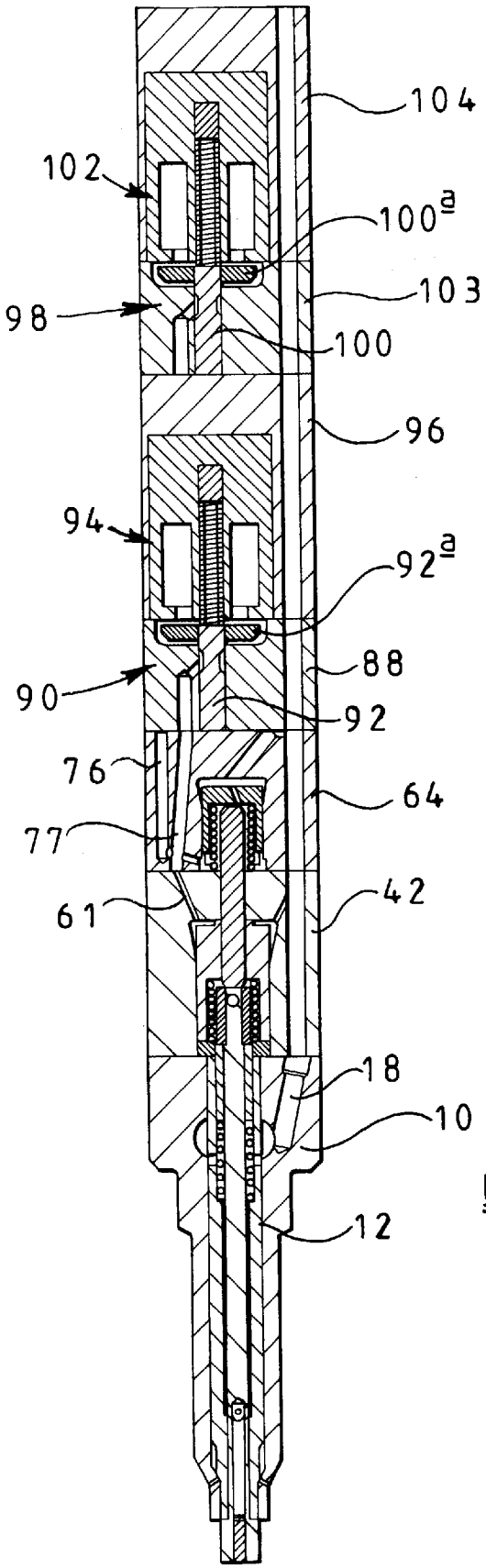
FIG. 1 is a sectional view of a fuel injector in accordance with an embodiment of the present invention.
Figure 2:
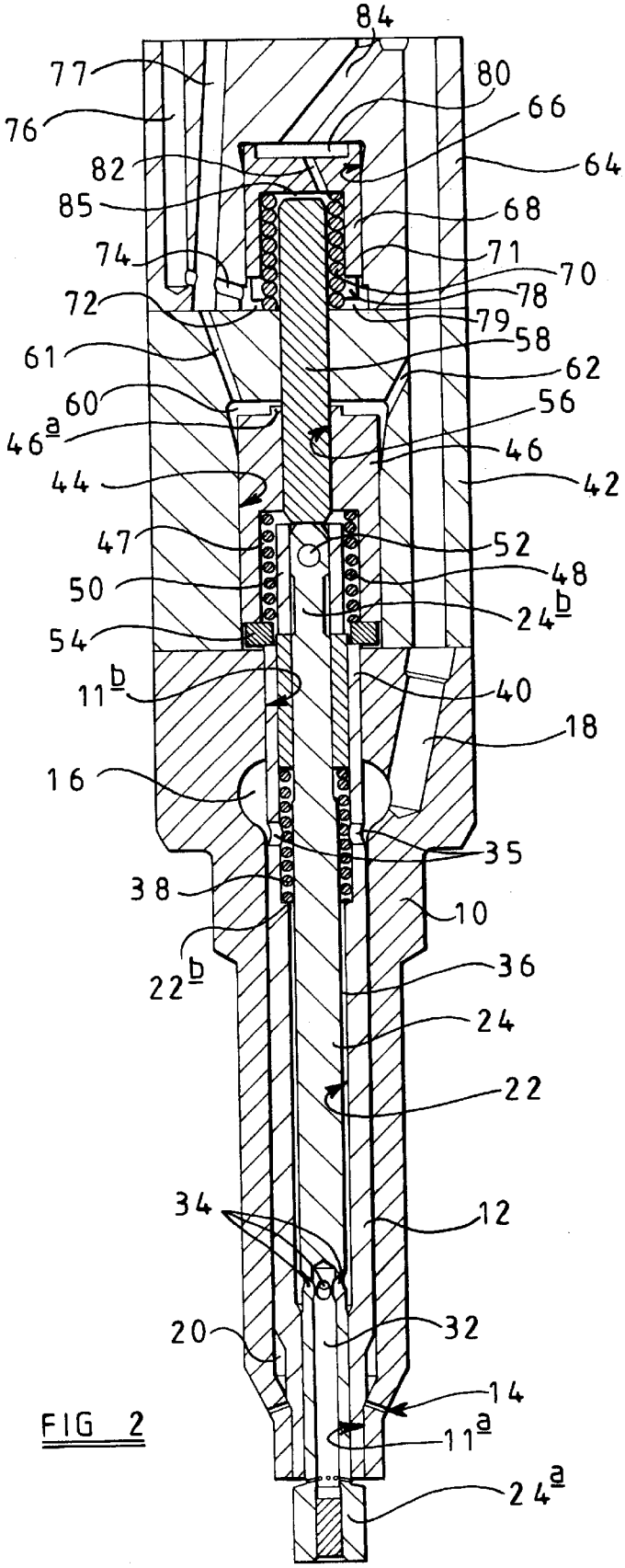
FIGS. 2 and 3 are enlarged views of a part of the fuel injector in FIG. 1.
Figure 3:
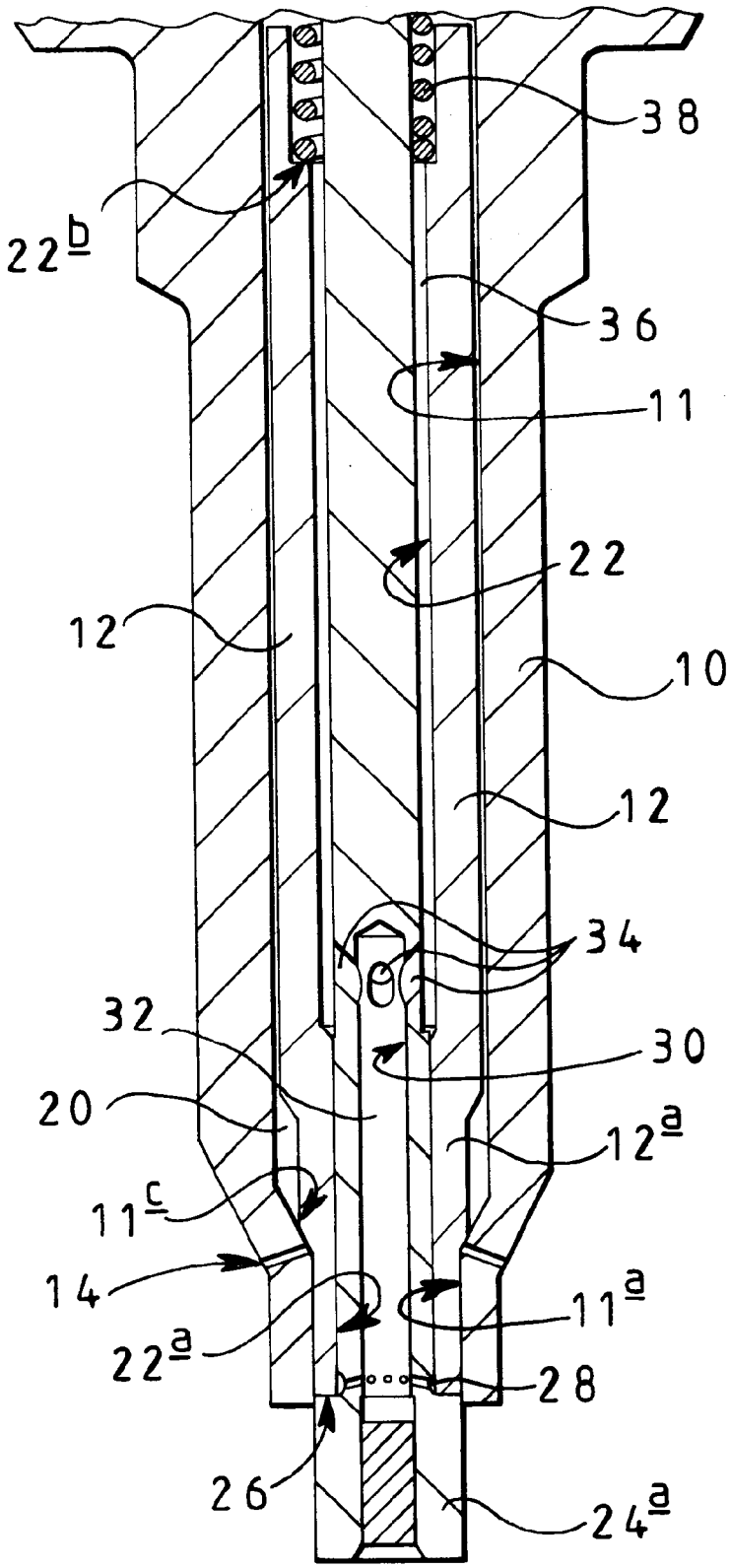

Referring to FIGS. 1 to 3, the fuel injector comprises a nozzle body 10 provided with a blind bore 11 within which a valve member 12 is slidable. As indicated in FIG. 2, the bore 11 includes a region 11*a* of reduced diameter and a region 11*b* of larger diameter at its end remote from the region 11*a*. The diameter of the valve member 12 adjacent the region 11*a* is substantially the same as the diameter of the region 11*a* such that the region 11*a* serves to guide sliding movement of the valve member 12 within the bore 11. Additionally, the region 11*b* has substantially the same diameter as the adjacent part of the valve member 12 such that movement of the valve member 12 is also guided by the bore region 11*b*. The bore 11 is also shaped to define a seating surface 11*c* with which a surface of the valve needle 12 is engageable to control fuel delivery through a first set of outlet openings 14 provided in the nozzle body 10.

The bore 11 defines an annular chamber 16, the annular chamber 16 being supplied with fuel under high pressure through a supply passage 18 formed in the nozzle body 10 and other parts of the fuel injector housing, from a source of high pressure fuel (not shown), for example the common rail of a common rail fuel system. The valve member 12 includes a region 12*a* which defines, together with a part of the bore 11, a first delivery chamber 20 for fuel, the delivery chamber 20 communicating with the annular chamber 16 by means of a narrow clearance defined between the valve member 12 and the nozzle body 10 such that, in use, fuel delivered to the annular chamber 16 is able to flow into the chamber 20. Conveniently, the narrow clearance may be defined, in part, by grooves, flats or slots provided on the surface of the valve member 12.

The valve member 12 is provided with a blind bore 22 within which a second valve member 24, or valve needle, is slidable, the bore 22 including a region 22*a* of reduced diameter, having substantially the same diameter as the adjacent part of the valve needle 24, such that movement of the valve needle 24 within the bore 22 is guided by the bore region 22*a*. The valve needle 24 includes, at its lowermost end, a region 24*a* of enlarged diameter which is engageable with a seating 26 defined by a lower surface of the valve member 12 to control fuel delivery through a second set of outlet openings 28 provided in the valve needle 24. The bore 22 defines a step 22*b* which abuts one end of a compression spring 38, the other end of the compression spring 38 being in abutment with a sleeve member 40 located within the bore 22 and through which the valve needle 24 extends. The spring 38 is arranged such that the valve needle region 24*a* is biased against the seating 26.

The valve needle 24 is also provided with a blind bore 30 which defines a flow passage 32 for fuel, the flow passage 32 communicating, via cross drillings 34 provided in the valve needle 24, with a second delivery chamber 36 defined by the bore 22 and the outer surface of the valve needle 24. The delivery chamber 36 communicates with the annular chamber 16 via cross drillings 35 provided in the valve member 12 such that, in use, when fuel under high pressure is supplied to the annular chamber 16, fuel is able to flow from the chamber 16 into the delivery chamber 36 through the drillings 35, and from the delivery chamber 36 into the flow passage 32 through the drillings 34. When the valve needle 24 is moved outwardly away from the seating 26, fuel in the flow passage 32 is able to flow out through the second set of outlet openings 28.

At its uppermost end, the nozzle body 10 abuts a distance piece 42 which is provided with a bore 44, a piston member 46 being slidable within the blind bore 44. At its uppermost end, the piston member 46 includes a stop member 46*a* which serves to limit the extent of upward movement of the piston member 46 within the bore 44, in use. The piston member 46 defines a spring chamber 47 which houses a second compression spring 48. A nut 50 is also housed within the spring chamber 47, the nut 50 being in screw-threaded engagement with a projection 24*b* at the uppermost end of the valve needle 24, the nut 50 being in abutment with the uppermost end surface of the sleeve member 40 and being retained in position by means of a locking pin member 52. One end of the compression spring 48 abuts a shim 54 connected with the upper end of the valve member 12 and the lower end surface of the piston member 46, the spring 48 acting on the shim 54 and, hence, the valve member 12 and serving to bias the valve member 12 in a downwards direction against the seating surface 11*c*.

The piston member 46 is farther provided with a bore 56, which communicates with the spring chamber 47, a load transmitting member 58 being slidable within the bore 56. The lowermost end of the member 58 is in connection with the projection 24*a* forming part of the valve needle 24 such that the member 58 is movable with the valve needle 24. The blind end of the bore 44 and the upper end face of the piston member 46 together define a first control chamber 60 for fuel, fuel under high pressure being supplied to the control chamber 60, in use, through a restricted drilling 62 provided in the distance piece 42 which communicates with a further drilling provided in the distance piece 42 forming part of the supply passage 18 for fuel.

The distance piece 42 abuts, at its end remote from the nozzle body 10, a housing 64 which is provided with a blind bore 66 within which a second piston member 68 is slidable. The piston member 68 is provided with a blind bore which defines, in part, a spring chamber 71 for a compression spring 70, the load transmitting member 58 extending into the chamber 71. The lower end 78 of the piston member 68 is provided with a slot, the slotted lower end 78 of the piston member 68 and the upper end face of the distance piece 42 together defining a clearance gap 79 which serves to limit the extent of movement of the piston member 68 within the bore 66, in use.

The upper end of the load transmitting member 58 and the blind end of the bore provided in the piston member 68 together define a clearance gap 85, the clearance gap 85 being smaller than the clearance gap 79 defined between the slotted end 78 of the piston member 68 and the distance piece 42 such that, in use, when the piston member 68 is moved in a downwards direction against the action of the spring 70 beyond an amount which exceeds the clearance gap 85, the blind end of the bore in the piston member 68 moves into engagement with the upper end surface of the load transmitting member 58, downward movement of the piston member 68 thereby being transmitted to the load transmitting member 58 and, thus, to the valve needle 24.

The bore 66 provided in the housing 64 defines, together with the upper end face of the distance piece 42, a second control chamber 72 for fuel and the blind end of the bore 66 defines, together with the upper surface of the piston member 68, a third control chamber 80 for fuel, the third control chamber communicating with the spring chamber 71 by means of a restricted drilling 82 provided in the piston member 68. The control chamber 80 communicates with the supply passage 18 by means of a further drilling 84 provided in the housing 64 such that, in use, fuel under high pressure is supplied to the third control chamber 80 through the supply passage 18. Fuel supplied to the control chamber 80 is able to flow into the control chamber 72 at a relatively low rate by means of the restricted drilling 82. The control chamber 60 and the control chamber 72 communicate with a low pressure fuel reservoir under the control of respective control valve arrangements, as will be described hereinafter, by means of drillings 61, 77 and drillings 74, 76 respectively provided in the distance piece 42 and the housing 64.

As shown in FIG. 1, the housing 64 abuts a further housing 88 within which a first control valve arrangement, referred to generally as 90, is arranged, the control valve arrangement 90 including a first valve member 92 which is moveable within a bore provided in the housing 88 under the action of an actuator arrangement 94 arranged within a housing 96. The actuator arrangement 94 shown in FIG. 1 is an electromagnetic actuator arrangement which includes an armature 92*a* in connection with the valve member 92. Similarly, the injector includes a second control valve arrangement, referred to generally as 98, which is arranged within a further housing 103. The second control valve arrangement 98 comprises a second valve member 100 in connection with an armature 100*a* of an associated electromagnetic actuator arrangement 102, the actuator arrangement 102 being arranged within a further housing 104. It will be appreciated, however, that the actuator arrangements 94, 102 need not be of the electromagnetic type and may, for example, be piezoelectric actuator arrangements.

In use, actuation and de-actuation of the actuator arrangements 94, 102 causes the armatures 100*a*, 92*a* respectively, and hence the valve members 100, 92 to move within their respective bores between open and closed positions. When the actuator arrangement 102 is actuated, the valve member 100 is moved to an open position in which fuel within the second control chamber 72 is able to flow, via the drillings 74, 76, to the low pressure fuel reservoir or drain. When the actuator arrangement 102 is de-actuated, the valve member 100 is moved to a closed position in which communication between the control chamber 72 and the low pressure fuel reservoir is broken. Similarly, when the actuator arrangement 94 is actuated, the valve member 92 is moved to an open position in which fuel within the first control chamber 60 is able to flow, via the drillings 61, 77, to the low pressure fuel reservoir. When the actuator arrangement 94 is de-actuated, the valve member 92 is moved to a closed position in which communication between the control chamber 60 and the low pressure fuel reservoir is broken.

In use, with the actuator arrangements 94, 102 de-actuated, fuel under high pressure is supplied to the annular chamber 16 from the source of fuel at high pressure through the supply passage 18 defined by drillings provided in the housings 64, 88, 96, 104, the distance piece 42 and the nozzle body 10. Fuel in the annular chamber 16 is able to flow, via the drillings 35, into the second delivery chamber 36 and into the first delivery chamber 20 via the narrow clearance defined between the valve member 12 and the nozzle body 10. Fuel under high pressure is also supplied to the control chamber 60 via the drilling 62. As the valve member 92 is in its closed position, fuel supplied to the control chamber 60 is unable to flow to the low pressure reservoir. The surface of the piston member 46 is therefore exposed to fuel under high pressure within the control chamber 60, the force due to fuel pressure within the control chamber 60 thereby urging the piston member 46 in a downwards direction. The force applied to the piston member 46, is transmitted, via the spring 48 and the shim 54, to the valve member 12, the valve member 12 being urged against the seating surface 11*c* due to the force applied to the piston member 46 and due to the spring force of the spring 48. With the valve member 12 seated against the seating 11*c*, fuel within the chamber 20 is unable to flow out through the first set of outlet openings 14 into the engine cylinder or other combustion space.

During this stage of operation, fuel under high pressure is also supplied, via the drilling 84, to the control chamber 80, a force being applied to the surface of the piston member exposed to fuel within a control chamber 80 to urge the piston member 68 in a downwards direction. Fuel within the control chamber 80 is able to flow, at a restricted rate, through the drilling 82, into the spring chamber 71 and, thus, into the control chamber 72. With the valve member 100 in its closed position, high pressure fuel within the control chamber 72 is unable to flow to the low pressure fuel reservoir. The effective areas of the piston member 68 exposed to fuel pressure within the control chambers 80, 72 and the effective area of the sleeve 40 exposed to fuel pressure within the chamber 16, are chosen to ensure that, during this stage of operation, the valve needle 24 is urged is an upwards direction such that the enlarged valve needle region 24*a* remains seated against the seating 26 and fuel delivery does not take place through the second set of outlet openings 28. Thus, during this stage of operation, fuel injection does not take place through either the first or second sets of outlet openings 14, 28.

Figure 4:
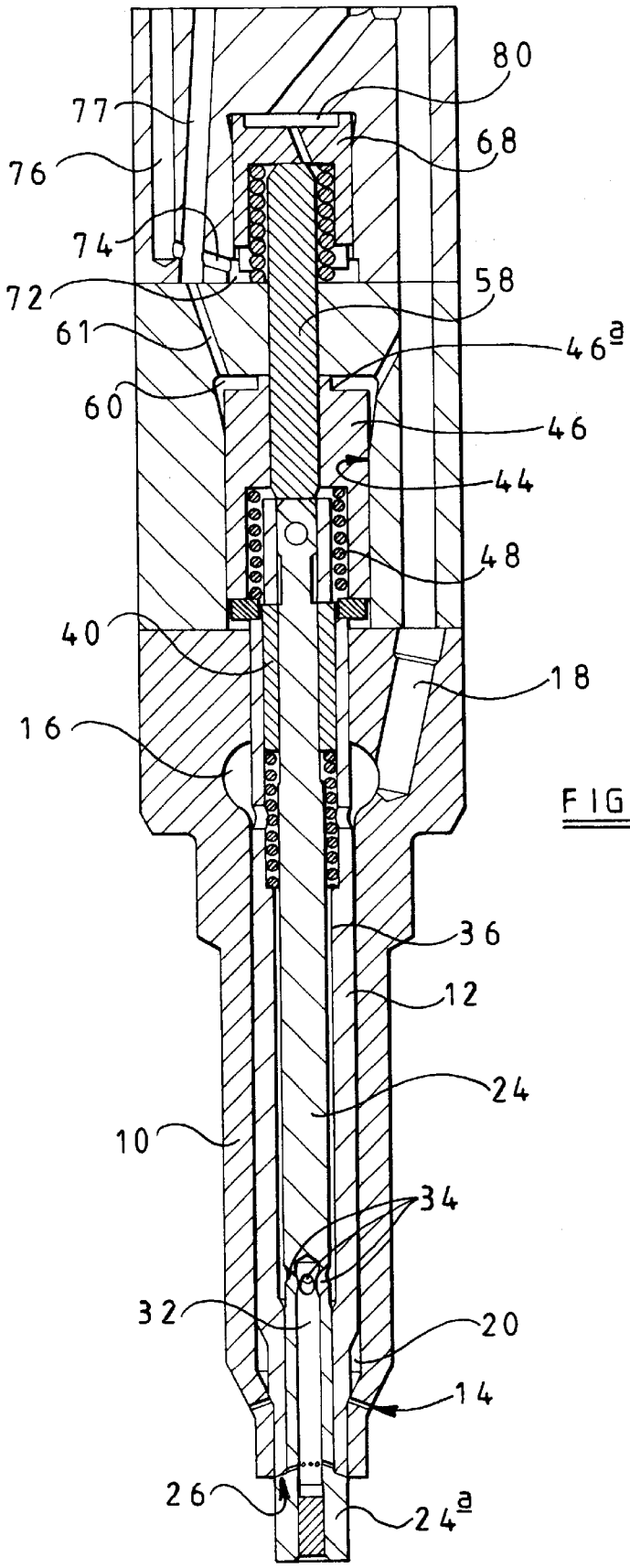
FIGS. 4 and 5 are views of the fuel injector in FIGS. 1 to 3 when in first and second fuel injecting positions respectively.

When it is desired to commence fuel injection through the first set of outlet openings 14, the actuator arrangement 94 is actuated to move the valve member 92 to its open position, high pressure fuel within the control chamber 60 thereby being able to flow, via the drillings 61, 77, to the low pressure reservoir. As fuel pressure within the first control chamber 60 is reduced, the force applied to the surface of the piston member 46 is also reduced. Under these circumstances, the force acting on the lower end face of the sleeve member 40 due to fuel pressure within the annular chamber 16 is sufficient to overcome the spring force due to the spring 48 combined with the reduced force applied to the piston member 46 such that the piston member 46 and the valve member 12 are urged in an upwards direction, the valve member 12 thereby moving away from the seating surface 11*c* to the position shown in FIG. 4. Fuel within the chamber 20 is therefore able to flow out through the first set of outlet openings 14 into the engine cylinder. As shown in FIG. 4, the extent of upward movement of the piston member 46, and hence the valve member 12, is limited by the clearance gap defined by the blind end of the bore 44 and the upper surface of the stop member 46*a*.

During this stage of operation, as the actuator arrangement 102 remains de-actuated, fuel pressure within the second and third control chambers 72, 80 remains high and thus, the valve needle 24 remains in a position in which the enlarged region 24*a* is seated against the seating 26. The second set of outlet openings 28 therefore remain covered by the valve member 12 and fuel is unable to flow out through the second set of outlet openings 28. It will be appreciated that, as shown in FIG. 2, as the clearance gap 85 is greater than the clearance gap defined between the stop member 46*a* and the blind end of the bore 44, upward movement of the valve member 12 away from the seating surface 11*c* is not transmitted, via the load transmitting member 58, to the piston member 68. This ensures the net force on the valve needle 24 is in an upwards direction, the enlarged end region 24*a* of the valve needle 24 therefore remaining seated against the seating 26 to prevent fuel delivery through the second set of outlet openings 28.

In order to cease fuel injection, the actuator arrangement 94 is de-actuated, thereby moving the valve member 92 to its closed position such that fuel pressure within the first control chamber 60 is increased. The force due to increased fuel pressure within the first control chamber 60, combined with the spring force 48, is sufficient to urge the piston member 46 and, hence, the valve member 12, in a downwards direction, thereby urging the valve member 12 against the seating surface 11*c* to close communication between the first delivery chamber 20 and the first set of outlet openings 14.

Starting from the position shown in FIGS. 1 to 3, with the actuator arrangement 94 de-actuated and the valve member 92 in its closed position, in order to inject fuel through the second set of outlet openings 28 the actuator arrangement 98 is actuated such that the valve member 100 moves to its open position. Fuel within the second control chamber 72 is therefore able to flow, via the drillings 74, 76, to the low pressure fuel reservoir. As fuel flow between the third control chamber 80 and the second control chamber 72 occurs at a relatively low rate, via a restricted drilling 82, it will be appreciated that the fuel pressure within the third control chamber 80 remains high. As fuel pressure within the second control chamber 72 is reduced, the force due to fuel under high pressure within the third control chamber 80 moves the piston member 68 downwardly into the position shown in FIG. 5, the blind end of the bore provided in the piston member 68 abutting the load transmitting member 58 to move the member 58, and hence the valve needle 24, in a downwards direction against the force applied to the surface of the sleeve member 40 due to fuel pressure within the annular chamber 16. The enlarged region 24*a* of the valve needle 24 is therefore moved away from the seating 26, fuel thereby being able to flow out through the second set of outlet openings 28.

Figure 5:
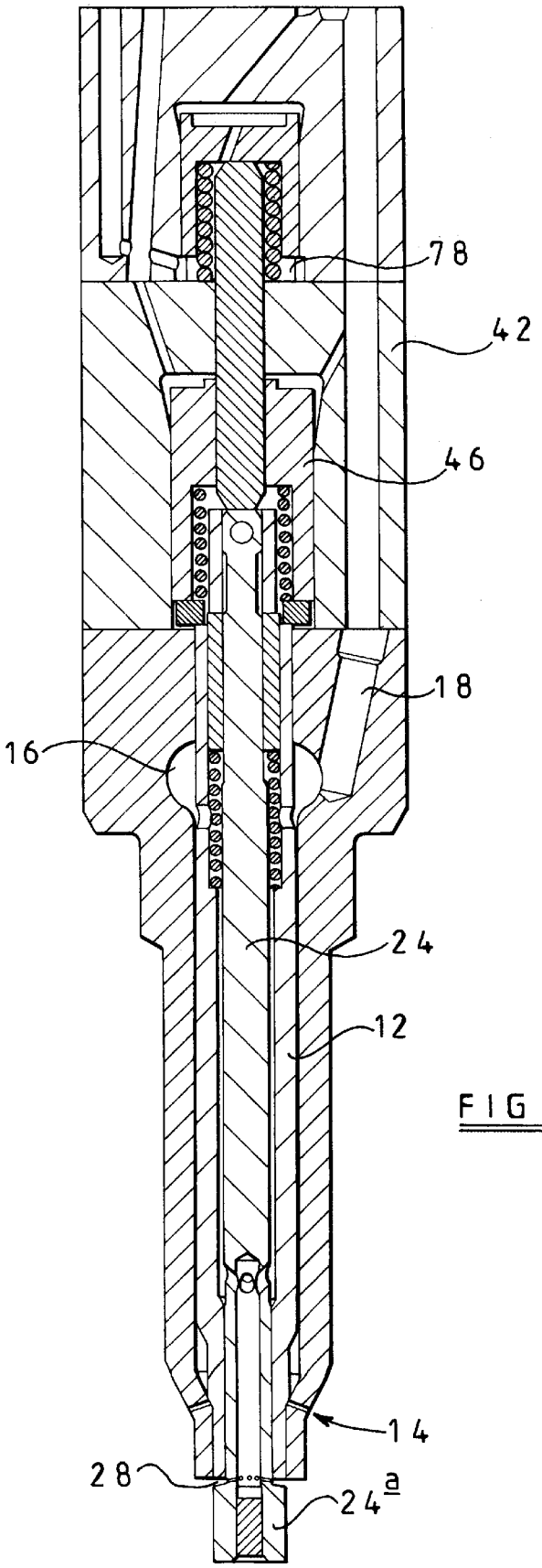

As the actuator arrangement 94 is de-actuated, fuel pressure within the control chamber 60 remains high and the valve member 12 is therefore maintained in its seated position against the seating surface 11*c*. Thus, during this stage of operation fuel injection only takes place through the second set of outlet openings 28. As shown in FIG. 5, the extent of movement of the enlarged region 24*a* of the valve needle 24 away from the seating 26 is limited by the clearance gap 79 defined between the lower end 78 of the piston member 68 and the distance piece 42, movement of the enlarged region 24*a* away from the seating 26 terminating when the lower end 78 of the piston member 68 abuts the distance piece 42.

In order to cease fuel injection, the actuator arrangement 102 is de-actuated, thereby moving the valve member 100 into its closed position such that high fuel pressure is re-established in the second control chamber 72, the piston member 68 and the valve needle 24 thereby being urged upwardly. Thus, the enlarged region 24*a* of the valve needle 24 is urged against the seating 26 to close the second set of outlet openings 28, thereby terminating fuel injection.

In order to permit fuel delivery at an increased rate, both the valve members 92, 100 are moved to their open positions, by actuating both actuator arrangements 90, 102 respectively, to reduce fuel pressure in both the first and second control chambers 60, 72. Under these circumstances, the valve member 12 is biased in an upwards direction, as the force applied to the surface of the piston member 46 exposed to fuel pressure in the first control chamber 60 is reduced, the valve member 12 thereby moving away from the seating surface 11*c* to expose the first set of outlet openings 14. Additionally, as fuel pressure within the second control chamber 72 is also reduced, the piston member 68 is urged in a downwards direction. Thus, the valve needle 24 is also moved away from its seating 26 to expose the second set of outlet openings 28. Fuel injection therefore takes place through both the first and second sets of outlet openings 14, 28.

By providing first and second sets of outlet openings 14, 28 of different size, or having a different number of openings in each set, or having openings with a different spray cone angle, selectively opening the first or second set of outlet openings 14, 28, or both sets of outlet openings, by controlling fuel pressure within the second and third control chambers 72, 80 permits the fuel injection characteristic to be varied, in use. Furthermore, fuel pressure within the flow passage 32 acts in a radially outwards direction, thereby serving to improve the seal between the valve member 12 and the nozzle body 10 and, in addition, the seal between the valve needle 24 and the valve member 12. Thus, leakage from the fuel injection is reduced. The arrangement is also advantageous as movement of the fuel member 12 and the valve needle 24 can be controlled with greater accuracy by controlling fuel pressure within the first and second control chambers 60 and 72.

What is claimed is:

1. A fuel injector comprising a nozzle body defining a first bore and an inwardly opening valve member slidable within the first bore, the valve member being engageable with a first seating to control fuel delivery through a first outlet opening provided in the nozzle body, the valve member being provided with a second bore within which an outwardly opening valve needle is slidable, the valve needle being engageable with a second seating to control fuel delivery through a second outlet opening provided in the valve needle, the fuel injector comprising first and second control chambers for fuel, whereby fuel pressure within the first and second control chambers controls movement of the valve member and the valve needle away from their respective seatings so as to permit fuel delivery through a selected outlet opening.

2. The fuel injector as claimed in claim 1, whereby movement of the valve needle in an outwards direction away from the second seating permits fuel delivery through the second outlet opening and movement of the valve member away from the first seating in an inwards directions permits fuel delivery through the first outlet opening.

3. The fuel injector as claimed in claim 1, wherein the valve needle defines a flow passage for fuel which communicates with a delivery chamber such that, when the valve needle is moved away from the second seating, fuel within the delivery chamber is able to flow through the flow passage for delivery through the second outlet opening.

4. The fuel injector as claimed in claim 2, wherein the valve needle defines a flow passage for the fuel which communicates with the delivery chamber such that, when the valve needle is moved away from the second seating, fuel within the delivery chamber is able to flow through the flow passage for delivery through the second outlet opening.

5. The fuel injector as claimed in claim 3, wherein the delivery chamber is defined by a part of the second bore provided in the valve needle and the valve member.

6. The fuel injector as claimed in claim 1, wherein the valve member includes a guide region which serves to guide sliding movement of the valve needle within the second bore.

7. The fuel injector as claimed in claim 1, wherein the valve member has a first surface associated therewith, the first surface of the valve member being exposed to fuel pressure within the first control chamber.

8. The fuel injector as claimed in claim 7, wherein the first surface is defined by a first piston member which is movable with the valve member.

9. The fuel injector as claimed in claim 1, wherein the valve needle has a second surface associated therewith, the second surface being exposed to fuel pressure within the second control chamber.

10. The fuel injector as claimed in claim 9, wherein the second surface is defined by a second piston member which is movable with the valve needle.

11. The fuel injector as claimed in claim 1, comprising a third control chamber for fuel, the third control chamber communicating with the second control chamber by means of a restricted flow path, fluid pressure within the third control chamber acting on the valve needle to urge the valve needle outwardly from the second bore.

12. The fuel injector as claimed in claim 11, wherein the valve needle has a second surface associated therewith, the second surface being defined by a second piston member which is movable with the valve needle, and wherein the restricted flow path is defined by a drilling provided in the second piston member.

13. The fuel injector as claimed in claim 1, wherein at least one of the valve needle and the nozzle body is provided with a plurality of outlet openings.

14. A fuel injector comprising a nozzle body defining a first bore and an inwardly opening valve member slidable within the first bore, the valve member being engageable with a first seating to control fuel delivery through a first outlet opening provided in the nozzle body, the inwardly opening valve member being provided with a second bore within which an outwardly opening valve needle is slidable, the valve needle being engageable with a second seating to control fuel delivery through a second outlet opening provided in the valve needle, the valve needle defining a flow passage for fuel which communicates with a delivery chamber such that, when the valve needle is moved away from the second seating, fuel within the delivery chamber is able to flow through the flow passage for delivery through the second outlet opening.

15. The fuel injector as claimed in claim 14, wherein the delivery chamber is defined by a part of the second bore provided in the valve needle and the valve member.

16. The fuel injector as claimed in claim 14, wherein the valve member includes a guide region which serves to guide sliding movement of the valve needle within the second bore.

17. The fuel injector as claimed in claim 14, wherein at least one of the valve needle and the nozzle body is provided with a plurality of outlet openings.

* * * * *